United States Patent [19]

Pridy

[11] 4,165,626

[45] Aug. 28, 1979

[54] WASH WATER SUPPLYING DRIVE HEAD AND SCRAPER AND CUTTER ASSEMBLY

[76] Inventor: Whetstine B. Pridy, 15522 Woodington Ave., Bellflower, Calif. 90706

[21] Appl. No.: 889,190

[22] Filed: Mar. 23, 1978

Related U.S. Application Data

[63] Continuation-in-part of Ser. No. 798,819, May 20, 1977, Pat. No. 4,131,005.

[51] Int. Cl.[2] ..... B21D 3/10; B21C 43/00

[52] U.S. Cl. ..... 72/40; 29/81 F; 72/389

[58] Field of Search ..... 29/81 R, 81 A, 81 B, 29/81 F, 81 G, 81 J, 407; 72/39, 40, 389

[56] References Cited

U.S. PATENT DOCUMENTS

| | | | |
|---|---|---|---|
| 1,879,009 | 9/1932 | Anthony | 29/81 F |
| 1,951,066 | 3/1934 | Shelly | 29/81 F |
| 1,984,771 | 12/1934 | Speller | 29/81 F |
| 2,004,422 | 6/1935 | Traut | 29/81 F |
| 2,996,789 | 8/1961 | Pridy | 29/81 A |
| 3,446,054 | 5/1969 | Pridy | 72/389 |

*Primary Examiner*—E. M. Combs

*Attorney, Agent, or Firm*—William C. Babcock

[57] ABSTRACT

An improved wash water supplying drive head and scraper and cutter assembly for use on an apparatus that sequentially receives tubular members such as oil well tubing, with each tubular member when in position on the apparatus being straightened, having rust and foreign material removed from the exterior surface, scale and other foreign material removed from the interior thereof, and the tubular member being hydraulically tested at a predetermined elevated pressure prior to being removed from the apparatus.

4 Claims, 9 Drawing Figures

FIG. 3
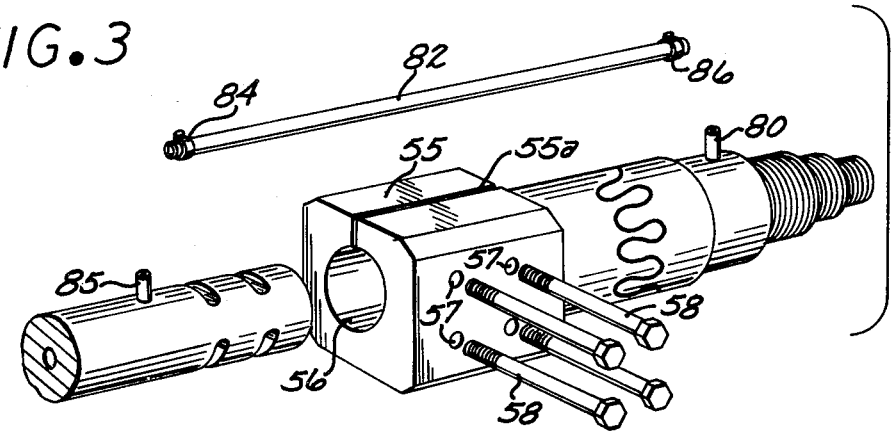
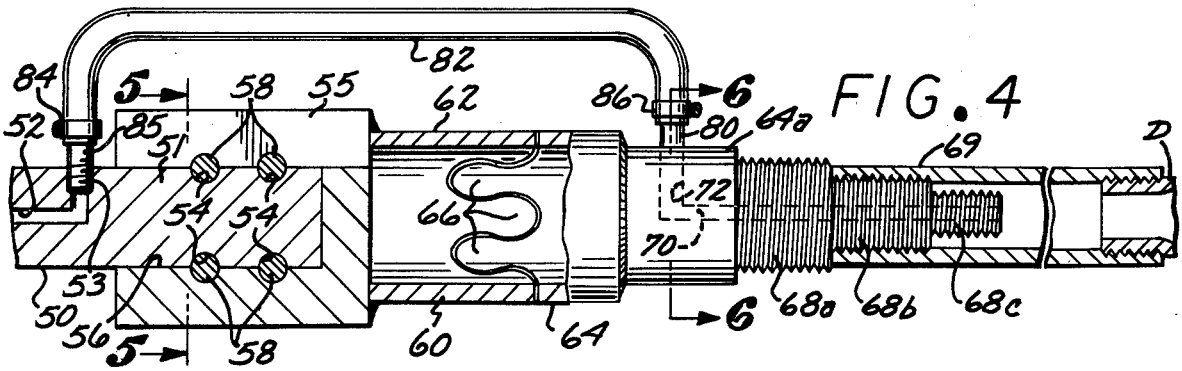
FIG. 4
FIG. 6
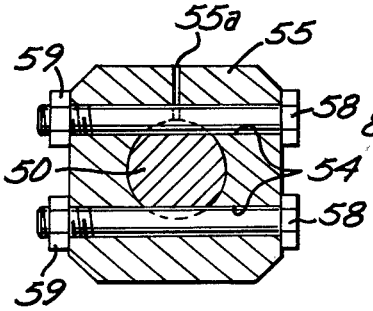
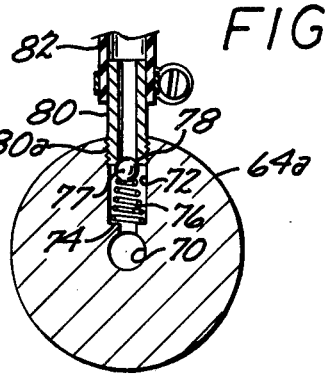
FIG. 5
FIG. 8
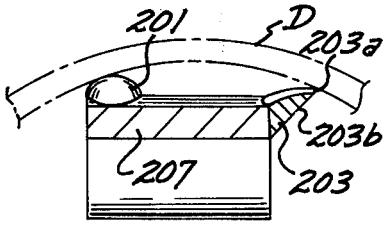
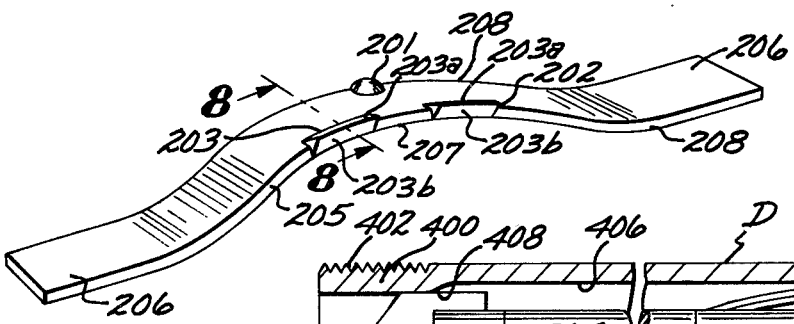
FIG. 7
FIG. 9
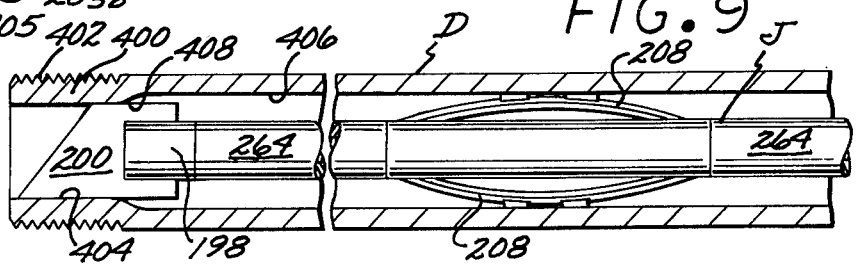

WASH WATER SUPPLYING DRIVE HEAD AND SCRAPER AND CUTTER ASSEMBLY

CROSS-REFERENCE TO RELATED APPLICATIONS

The present application is a continuation-in-part of my co-pending patent application entitled "Tubular Member Straightening, Descaling and Hydraulic Testing Apparatus" Ser. No. 798,819 filed in the United States Patent Office on May 20, 1977, U.S. Pat. No. 4,131,005.

BACKGROUND OF THE INVENTION

1. Field of the Invention

Improved Wash Water Supplying Drive Head and Scraper and Cutter Assembly.

2. Description of the Prior Art

In the operation of the apparatus disclosed and claimed in my co-pending application above-identified it has been found that the flexible tubular member that supplies wash water to the tubular member being descaled and that extends through the drive head has a relatively short life and the descaling assembly used in my prior art apparatus does not assure that all scale will be removed from a tubular member, particularly when it is hard and rocky in character.

A major object of the present invention is to provide an apparatus in which the passage for wash water through the drive head is of such construction that it is subjected to a minimum of flexing and abrasion, and as a result the drive head assembly will have a long and useful life with a minimum of maintenance attention.

Another object of the invention is to supply a scraper assembly that both cuts and scrapes scale from the interior surface of a tubular member as the latter is rotated, and by water discharged from the driving head rearwardly through the tubular member either during the straightening thereof or the removal of scale from the interior, maintaining the temperature of the tubular member sufficiently low as to not be detrimental to the metal defining the tubular member without raising the temperature of the tubular member during this operation to the extent that the raised temperature is detrimental to the metal defining the tubular member.

A further object of the present invention is to provide a single apparatus and method of using the same on which a tubular member may be removably disposed to be subjected to a sequence of operations in which the tubular member has foreign material removed both from the interior thereof by a combined cutting and scraping action, is straightened, is hydraulically tested, and with the threads of the tubular member cleaned of foreign material.

Yet another object of the invention is to provide an apparatus and method of using the same for the reconditioning of tubular members, and the segregation of serviceable tubular members from unserviceable ones thereof.

A still further object of the invention is to supply an apparatus and method of using the same in which hard material deposited as a layer in a tubular member, or a cement core in the tubular member is fractured by sequentially transversely deforming sections of the tubular member and then removing the hard deposited material or cement from the tubular member by a combined cutting and scraping action during which time the tubular member is maintained relatively cool by discharging water longitudinally and rearwardly through the tubular member, and the water carrying cutting and chips therewith to discharge through the rearward end of the tubular member.

Another object of the invention is to provide an apparatus and method of using the same to both straighten and remove foreign material from the interior and exterior of a metallic tubular member without raising the temperature of the tubular member to the extent that the physical properties of the metal defining the same will be impaired.

SUMMARY OF THE INVENTION

The apparatus is illustrated as including first and second wheeled vehicles that are axially aligned and may be moved from place to place as a unit. The first vehicle includes movable power driven means to lift tubular members of different diameters to a position from which they roll to a centered longitudinal position on the first vehicle.

A power operated driving member on the first vehicle removably engages the tubular member when in the centered position to thereafter rotate the tubular member, with water at low pressure being discharged through the driving member into the tubular member to flow towards the rearward end thereof. As the tubular member rotates, power means move a carriage longitudinally on the first vehicle towards the rearward end thereof, with the carriage supporting a hydraulically operated ram that forces a first pressure pad downwardly onto the tubular member in a position intermediate two second pressure pads carried by the carriage and on which the tubular member rests. The first and second pressure pads cooperate as the supporting carriage moves rearwardly on the apparatus to concurrently straighten the tubular member and remove foreign material and rust from the exterior surface thereof by sequentially transversely deforming longitudinal sections of the tubular member.

As longitudinal sections of the tubular member are transversely deformed by pressure exerting pads supported on the carriage, hard scale that has been deposited in the tubular member, or a cement core that may be present in the interior of the tubular member is fractured. During the movement of the carriage on the first vehicle, a flow of low pressure water is maintained through the centered tubular member to prevent substantial heating of the tubular member during the straightening operation.

After the hard foreign material in the tubular member has been fractured, the fractured material may be removed by advancing a reamer longitudinally through the tubular member, which reamer is supported on the second vehicle and moves longitudinally relative thereto.

During the straightening operation as well as the reaming of scale from the interior of the tubular member, low pressure water from the drive head of the present invention is allowed to flow rearwardly through the tubular member to cool the same as well as carry cuttings and chips rearwardly in the tubular member to discharge from the latter.

During the removal of scale from the tubular member, the combined scraper and cutter assembly of the present invention removes the scale with a minimum rise in temperature of the tubular member.

After the tubular member has been straightened and foreign material removed from both the outside and inside thereof, the threads on the rearward end of the tubular member are cleaned by contact with a stiff brush. A movable fixture on the rearward end of the first vehicle is now placed in fluid tight engagement with the rearward end of the tubular member. Low pressure water continues to flow into the tubular member and substantially fills the same. High pressure water is now discharged into the tubular member from the fixture, and water in the tubular member being prevented from discharging therefrom by a check valve operatively associated with the driving member. A visually observable hydraulic gauge is in communication with the interior of the tubular member.

This high pressure water is discharged into the tubular member until the gauge indicates a predetermined pressure has been reached. Flow of high pressure water to the tubular member is now terminated, and the gauge observed to see if there is a drop in pressure. If there is a pressure drop this indicates that the tubular member leaks and is not serviceable for future use in an oil well. During the build-up of hydraulic pressure in the tubular member, the tubular member may split or have a stream of water discharge through a hole therein, which of course without further testing indicates that the tubular member is not serviceable and should be discarded. After a tubular member is tested as above described, the tubular member is removed by power means from the apparatus and another tubular member mounted on the apparatus for testing.

BRIEF DESCRIPTION OF THE DRAWINGS

FIG. 3 is an exploded perspective view of the wash water supplying drive head assembly;

FIG. 4 is a combined side-elevational and longitudinal cross-sectional view of the drive head assembly shown in FIG. 3;

FIG. 5 is a transverse cross-sectional view of the drive head assembly taken on the line 5—5 of FIG. 4;

FIG. 6 is a fragmentary cross-sectional view of the check valve taken on the line 6—6 of FIG. 4;

FIG. 7 is a perspective view of one of the bow springs that supports hardened cutters and a hardened scraper button;

FIG. 8 is a transverse cross-sectional view of the bow spring taken on the line 8—8 of FIG. 7; and FIG. 9 is a side elevational view of the scraper and cutter assembly disposed within a tubular member.

DESCRIPTION OF THE PREFERRED EMBODIMENT

Figure 1:
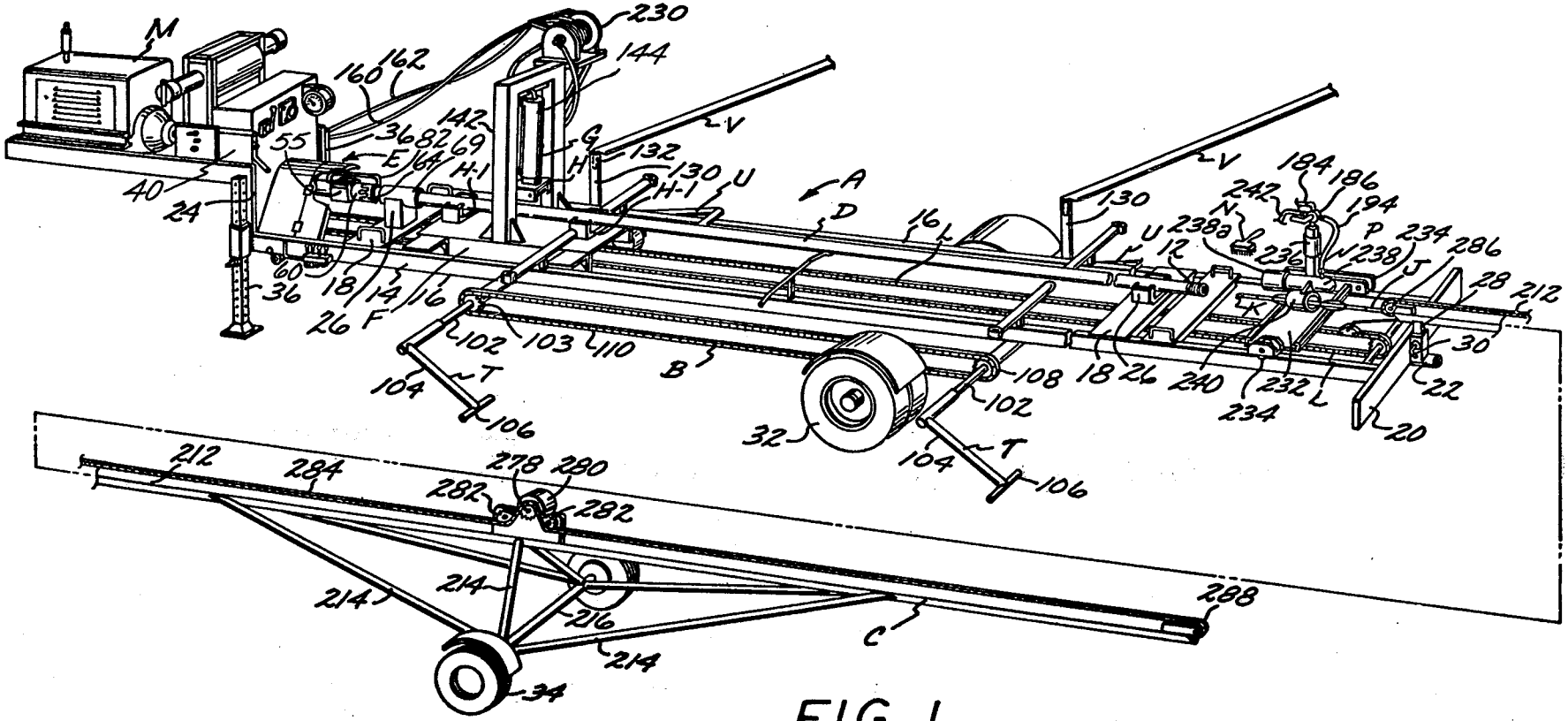
FIG. 1 is a perspective view of the apparatus of the present invention that includes a first vehicle that is capable of straightening a length of a tubular member when the latter is in a centered position thereon, removes rust and foreign material from the exterior surface thereof, hydraulically tests the tubular member to a desired pressure, have the threads on the ends of the tubular member cleaned and coated with a protective film of oil, and by the use of a second vehicle removably connected to the rearward end of the first vehicle, foreign material in the tubular member that has been fractured by the straightening operation is reamed from the tubular member.

The apparatus A of the present invention as illustrated in FIG. 1 includes a first vehicle B and a second vehicle C that is longitudinally aligned with the first vehicle and movably connected thereto. The first vehicle B is adapted to have a tubular member D, such as drill pipe, upset oil well tubing, or the like, removably disposed in a longitudinal centered position thereon to be rotated by a driving assembly E situated at the forward ends of the first vehicle. A carriage F is longitudinally movable on the first vehicle B, with the carriage F supporting a hydraulic assembly G that includes an upwardly disposed pressure pad H and a pair of longitudinally spaced pressure pads H-1, as may be seen in FIG. 1, that at least partially support the tubular member. The second vehicle B slidably supports an elongate rigid element J for longitudinal movement relative thereto, with the elongate element J on the forward end thereof supporting a reamer K. A first endless chain link belt L is rotatably supported in a longitudinal position on the first vehicle B, with the belt having the carriage F connected thereto. When the first belt L is rotated in an appropriate direction, it will be seen from FIG. 1 that the carriage F moves towards the rearward end of the first vehicle B.

During the rearward movement of the carriage F the hydraulic assembly G is actuated to sequentially transversely deform sections of the tubular member D as the latter rotates to not only straighten the tubular member but to fracture solid deposited foreign material within the interior thereof. The pressure pad H during the straightening operation is in frictional contact with the rotating tubular member D and the latter is heated as a result. Such heat is detrimental to the metal defining the tubular member D and is substantially eliminated by discharging a stream of cooling water from the driving assembly E rearwardly through the tubular member. This stream of water serves a second function that will later be described. After the tubular member D has been straightened, the threads on the rearward end of the tubular member D is cleaned as the tubular member rotates by being brought into contact with a brush N to remove rust and foreign material from the threads and the threads then being coated with a film of protective oil.

After foreign material has been removed from an exterior surface of the tubular member D, the tubular member straightened, foreign material is removed from the interior thereof by advancing the reamer K forwardly through the tubular member to remove fractured foreign material therefrom. During the reaming of foreign material from the interior of the tubular member D, water discharges rearwardly therein through the driving assembly E, which driving assembly has a check valve R associated therewith as shown in FIG. 6, which water serves a first function of maintaining the tubular member at a sufficiently low temperature that the metal defining the tubular member is not adversely effected and a second function of carrying cuttings longitudinally through the tubular member to the rearward end thereof. The tubular member D is thereafter hydraulically tested as will later be described and thereafter removed from the first vehicle B. The tubular member D is raised onto the first vehicle B by use of a pair of pivotally supported first elevators T, and a second pair of like elevators U being utilized to raise a tubular member after it has been reconditioned to a position where it may roll from the first vehicle on a pair of outwardly extending arms V as shown in FIG. 1.

The tubular member D as may be seen in FIG. 1 includes a first end 10 that is forwardly disposed when the tubular member is longitudinally positioned on the first vehicle B, and a second end 12 that is rearwardly disposed when the tubular member is so mounted on the vehicle. The first vehicle B includes a chassis 14 that is defined by a pair of laterally spaced side pieces 16 that have forward and rearward cross pieces extending therebetween. The chassis also includes a rearward end piece 20 which end piece supports an upwardly extending socket 22.

Figure 2:
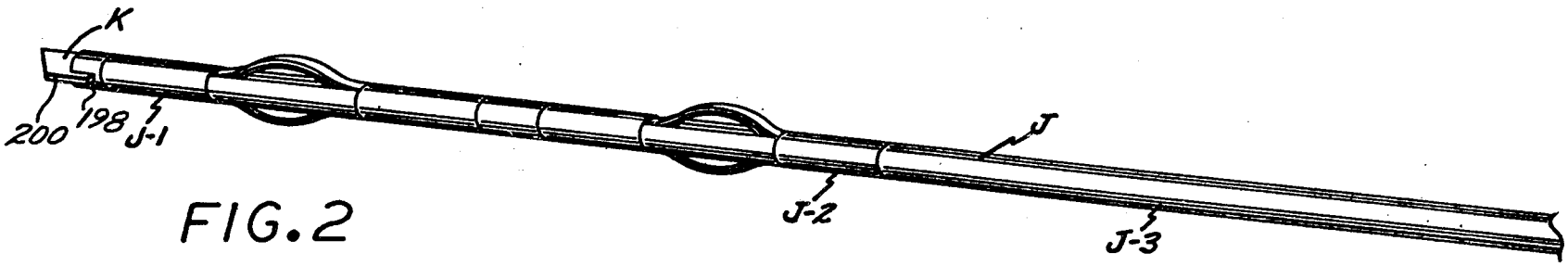
FIG. 2 is a fragmentary perspective view of the descaling unit used in removing hard foreign material from the interior of a straightened tubular member.

The forward end of the chassis 14 has an upwardly and forwardly extending frame secured thereto on which an engine M may be mounted. The tubular member D after being longitudinally positioned on the first vehicle B is removably held in a centered position thereon by two longitudinally spaced supports 26 that extend upwardly from the cross pieces 18 as illustrated in FIG. 1. The forward end of the second vehicle C has a pin 28 projecting downwardly therefrom that removably engages the upwardly extending socket 22, and is held in a locked position therein by a rotatably threaded member 30 that is disposed in a tapped bore (not shown) in the socket member 22. The first vehicle B as may be seen in FIG. 2 is supported on a first set of pneumatic tired wheels 32 and the second vehicle C on a second set of pneumatic tired wheels 34. A pair of vertically adjustable legs 36 are operatively associated with the forward ends of the first vehicle B and with these legs 36 serving to support the forward end of the vehicle at a desired elevation.

The engine M as may be seen in FIG. 16 has a first drive shaft 38 extending rearwardly therefrom to a transmission 40, which transmission has a number of power take-offs therewith as shown in my co-pending application in detail. The transmission 40 also drives a heavy wall, horizontal, bearing supported tube 50. The driving assembly E shown in FIG. 1 includes a driven tube 50 that has a solid rearward end portion 51, and a bore 52 that extends forwardly therefrom that is connected to a source of low pressure water (not shown). The rearward end of bore 52 is in communication with a transverse tapped bore 53 formed in end portion 51. Two sets of transverse parallel slots 54 are formed in rearward end portion 51, and are illustrated in the drawing as being disposed rearwardly of tapped bore 53.

A heavy rigid block 55 is provided that has a rearwardly extending cylindrical cavity therein that snugly engages a part of the rearward end portion 51 as shown in FIG. 4. Two sets of transverse bores 57 are formed in block 55 that are aligned with slots 54. The bores 57 have bolts 58 extended therethrough, which bolts also engage slots 54 to prevent block 55 rotating relative to the power driven tube 50. The bolts 58 are engaged by nuts 59 as shown in FIG. 5. A thin longitudinal slot 55*a* is formed in block 55 as shown in FIG. 5, to cause the portions of the block on opposite sides of slot 55*a* to be forced into pressure contact with rearward end portion 51 when the nuts 59 are tightened on bolts 58.

A driving head 60 is welded or otherwise secured to the rearward end of block 55 as shown in FIG. 4. The driving head 60 includes a forward tubular section 62 and a rearward tubular section 64 that are connected together by interengaging circumferentially spaced fingers 66 that permit limited transverse flexing of rearward section 64 relative to forward section 62. The rearward tubular section 64 includes a solid portion 64*a* from which externally threaded sections 68*a*, 68*b* and 68*c* of decreasing diameter extend rearwardly. Three internally threaded tubular connectors 69 of different diameters are provided, each of which is capable of threadedly engaging one of the threaded sections 68*a*, 68*b* and 68*c*. Each connector 69 may engage a forwardly disposed externally threaded end of a tubular member D of appropriate diameter, with one such connection being shown in FIG. 4.

A longitudinal bore 70 extends through sections 68*a*, 68*b* and 68*c* and portion 64 to intersect a transverse bore 72 formed in portion 64. Bore 72 has a body shoulder 74 defined therein. A check valve assembly R is provided by a compressed helical spring 76 that rests on body shoulder 74 and tends at all times to force a ball 77 into sealing contact with a tapered seat 78 of a nipple 80 that has an externally threaded end portion 80*a* that engages a tapped portion of the bore 72. A nipple 85 has an externally threaded end portion that engages the tapped bore 53 as may be seen in FIG. 4.

An elongate pliable hose 82 has the end portions thereof in engagement with nipple 85 and nipple 80, and the end portions being held thereon by first and second hose clamps 84 and 86 of conventional design. Each elevator T as may best be seen in FIG. 1 includes a shaft 102 that is rotatably supported by conventional means from the chassis 14, and the shaft on its outer end having an arm 104 disposed normally thereto, and the arm on the free end including a cross-piece 106 that may serve as a support for one of the tubular members D as the latter is being raised to a position where it may be rolled onto the first vehicle A to occupy a centered longitudinally extending position thereon. Each shaft 102 has a sprocket 108 rigidly secured thereto, and the sprockets having an endless chain belt 110 extending therebetween as shown in FIG. 1. The rotation of the sprockets 108 by power means as described in my co-pending application results in the first elevator T being pivoted upwardly as viewed in FIG. 1 to position the elevators where a tubular member resting thereon may be rolled onto the first vehicle A to occupy a centered longitudinal position thereon.

The second elevators U are of the same structure as the first elevator T and are actuated by power means described in my co-pending application. Two longitudinally spaced uprights 130 are secured to the chassis 14 in longitudinal spaced relationship as shown in FIG. 1 and by pins 132 that slidably engage cavities in the upper portions of the uprights support arms V in the outwardly extending position shown in FIG. 1. After tubular member D has been reconditioned, the second elevators U are employed to raise the tubular member to an elevated position where it may be rolled from the supporting portions of the second elevators onto the arms V, where the tubular member may roll to be disposed in a stack or otherwise handled. An inverted U-shaped frame 142 extends upwardly from the carriage F and a hydraulic cylinder assembly 144 is supported in a depending position within the U-shaped frame 142 and is adapted to move a pressure pad H vertically. Two second pressure pads H-1 are supported on the platform 134 with the first pad H intermediately disposed therebetween. The pressure pads H and H-1 when in pressure contact with the exterior surface of the tubular member D as it rotates are moved longitudinally relative to the rotating tubular member by carriage F and frictionally engage the exterior surface of the tubular member and remove rust and corrosion therefrom as well as to deform the tubular member transversely to straighten the same. Hydraulic fluid under pressure is supplied to cylinder 144 through conduits 160 and 162 as explained in detail in my copending application.

The first endless chain belt L, as can best be seen in FIG. 1, extends between a forwardly disposed sprocket (not shown) that is driven by a power take-off from the transmission 40. The carriage F is connected to the belt L. When the belt L is driven and with a desired force being exerted by the pressure pads H, H-1 on the tubular member D the tubular member is straightened as explained in detail in my copending application.

A hydraulic testing assembly P is provided for the testing of each tubular member D while in position on the apparatus A as shown in FIG. 1. The valve 186 is supported on an upright 236 that is secured to a transverse platform 232 that is movably supported by rollers 234 on the rearward portion of the side pieces 16. An elongate cup 238 is supported from platform 232, which cup has an internally threaded coupling 238*a* on the forward end thereof that may be removably connected to the rearward threaded end of a tubular member D when the latter is removably supported on the apparatus A as shown in FIG. 1. Conduit 194 is in communication with the interior of cup 238. After the tubular member has been straightened and foreign material reamed and cut from the interior thereof, the coupling 238*a* is connected to the rearward end of the tubular member D. Low pressure water from the driving head E is allowed to substantially fill the tubular member D. When this operation is completed valve 186 is manually disposed to allow high pressure water from the assembly P to discharge into the tubular member until a desired pressure is reached that is indicated in a gauge (not shown). The element J illustrated in FIG. 2 is used for reaming and cutting fractured foreign material from the interior of tubular members D when there is a longitudinal passage in the foreign material through which water may flow rearwardly. Element J is formed from a number of elongate sections J-1, J-2. and J-3. The section J-1, shown in FIG. 9, has a threaded cavity in the forward end thereof that is engaged by a threaded plug 198 that supports a reamer blade 200 on the forward end thereof.

A number of still bow springs 208 are provided, each of which includes two flat end sections 206, and a centrally disposed bowed portion 207. The bowed portion 207 on a first longitudinal edge 205 thereof supports two hard cutting members 203 that are positioned on opposite sides of the center thereof. Each of the cutting members 203 is formed from a material that is harder than the scale (not shown) that will be encountered on the interior surface of a tubular member D. Each cutting member defines a longitudinal cutting edge 203*a* from which a side surface 203*b* extends inwardly to the bowed portion 206. A dimple 201 of hardened material is mounted on bowed portion 207 as shown in FIGS. 7 and 8.

Each of the bow springs 208 is held in a fixed longitudinal position on element J and non-rotatable relative thereto by a pair of sleeves 264 as explained in detail in my copending application. Each sleeve removably engages an end portion 206.

The second vehicle C as shown in FIG. 1 includes an elongate shell 212 and is supported in a substantially horizontal position by a downwardly extending frame 214 that have the second pair of pneumatic tired wheels 34 rotatably mounted thereon. The shell 212 is of non-circular transverse cross-section.

Shell 212 has a block of non-circular transverse cross-section (not shown) slidably mounted therein.

A hydraulic motor 278 is mounted on the upper central portion of shell 212 and includes a driving sprocket 280. The motor 278 rotatably supports two idling sprockets 282 on opposite sides of the driving sprocket 280. The sprockets 280 and 282 are engaged by an endless chain link belt 284. Shell 212 rotatably supports a sprocket 286 on the forward end thereof and a sprocket 288 on the rearward end thereof that engage belt 284.

The endless belt 284 extends longitudinally through the shell 212 and is connected to the block (not shown) slidably mounted therein, which block has the element J extending forwardly therefrom. By actuating the hydraulic motor 280, the belt 284 is rotated and the element J may be moved forwardly or rearwardly as desired in the tubular member D.

In FIG. 9 the tubular member D is shown as upset tubing, which has heavy walled end portions 400 that have external threads 402 and a bore 404 extending therethrough that is of smaller diameter than the bore 406 of the upset tubing between the end portions. The bores 404 and 406 at their junction define ring-shaped body shoulders 408. The The blade K is of such width that it may slide through the bore 404, but will not be in reaming contact with the interior surface defining the bore 406. The bow springs 208 are removably supported on the element J by sleeves 264 as oppositely disposed pairs, and are of such dimensions and resiliency that the hardened cutting members 203 and beads 201 tend to at all times be forced outwardly to contact the interior surface of tubular member D. As the element J is advanced forwardly through the tubular member D as the latter rotates towards the cutting edges 203*a*, foreign material (not shown) is cut therefrom by the cutting members 203, and foreign material that may escape such cutting is scraped from the interior surface of the tubular member by rotational pressure contact with the hardened bead 201. The hardened material defining the cutting members 203 and beads 201 may be any one of the commercially available hard cutting alloys or metals that may be welded or otherwise secured to the bow spring 208. During the cutting and scraping operation substantial head is generated in the tubular member D that could raise the temperature thereof to the extent that the metal defining the tubular member D would be damaged, as well as raising the temperature of the tubular member D to the extent that it would tend to bow downwardly were it placed in a horizontal rack after removal from the invention. This detrimental heating of the tubular member D is eliminated by the use of the driving head assembly E that discharges a stream of cooling water rearwardly through the tubular member in sufficient volume to maintain the tubular member cool, and at a sufficient rate as to carry cuttings rearwardly in the tubular member to discharge from the rearward end thereof. At least one bead 201 is so disposed longitudinally on each bow spring 208 that they contact body shoulders 408 and remove foreign material therefrom as the element J is advanced forwardly through the upset tubing D.

The use and operation of the invention has been described previously in detail and need not be repeated.

What is claimed is:

1. An apparatus for straightening a tubular member and removing foreign material from the interior thereof, said apparatus being of the type that includes an elongate bed that has a forward and rearward end, an elongate rigid element that may be moved longitudinally through said tubular member after the latter has been straightened and still rests on said bed, a prime mover mounted on said forward end of said bed, said apparatus being characterized by:

a. a horizontally disposed tubular member rotatably supported in a centered longitudinal position adjacent said forward end of said bed and rotated by said prime mover, said tubular member a forward end and a rearward sold end portion, a transverse bore in said solid end portion that communicates with a longitudinal bore that extends forwardly through said tubular portion, said solid end portion having a plurality of transverse slots therein, said longitudinal bore in communication with a source of low pressure water;

b. a rigid block that has a rearwardly extending cavity that snugly engages a rearward part of said rearward solid end portion, said block having a plurality of transverse bores that are aligned with said slots;

c. a plurality of bolts that extend through said bores to engage said slots to prevent said block rotating relative to said tubular member, said bolts having threaded portions that project from said block;

d. a plurality of nuts that engage said threaded portions of said bolts;

e. forward and rearward tubular sections that have interengaging fingers that permit said rearward tubular section to flex transversely relative to said forward tubular section, said forward tubular section secured to said block;

f. a solid rigid body secured to said rearward tubular portion, said rigid body having a transverse bore therein;

g. a plurality of externally threaded sections of decreasing diameter, with said section of greatest diameter secured to said body, and a bore that extends longitudinally through said sections and is in communication with said transverse bore in said body;

h. check valve means in said transverse bore in said body that permits flow of water from said transverse bore in said body to said bore in said sections;

i. first and second nipples secured to said solid end portion and said body and in communication with said transverse bores therein; and j. a pliable hose that extends between said first and second nipples and is secured thereto, said hose being free of abrasive action when said tubular member, block, forward and rearward tubular portions, body and sections rotate concurrently as a unit, with water discharged into said tubular member flowing through said hose to discharge from longitudinal bore in said sections into said tubular member being straightened, with the latter having threaded ends, and one of said threaded ends connected to one of said threaded sections to cause rotation of said threaded member being straightened as said horizontally disposed tubular member is rotated by said prime mover.

2. An apparatus as defined in claim 1 in which said tubular member being straightened has externally threaded end portions, and said apparatus including:

k. a tubular connector having internally threaded ends, one of which ends engages a threaded end portion of said tubular member being straightened and the other of said threaded ends an appropriate one of said threaded sections.

3. An apparatus as defined in claim 1 in which said transverse bore in said body has a body shoulder and the end of said second nipple most adjacent said body shoulder defines a valve seat and said check valve means includes:

k. a ball longitudinally movable in said transverse bore in said body that can seal with said valve seat; and l. a compressed helical spring in said transverse bore in said body that at all times tends to maintain said ball in sealing engagement with said valve seat.

4. An apparatus as defined in claim 1 which in addition includes:

k. a bow spring that has an outwardly bowed arcuate center portion and two flat end portions that extend in opposite directions therefrom, said bowed center portion and end portions having first and second longitudinal edges;

l. first means on said elongate rigid element that removably engage said flat end portions and hold said bow spring in a fixed position on said elongate element when said tubular member that has been straightened is rotated towards said first longitudinal edge; and m. two longitudinally spaced hardened knives that are secured to said bowed center portion of said bow spring and project outwardly therefrom to pressure contact foreign material on the interior surface of said tubular member that has been straightened as the latter rotates.

* * * * *